United States Patent [19]

Takii et al.

[11] Patent Number: 4,968,526

[45] Date of Patent: Nov. 6, 1990

[54] METHOD FOR FABRICATING A KEY TOP

[75] Inventors: Yasuo Takii; Toshiji Chiba, both of Furukawa; Shigeru Satoh, Miyagi; Shinichi Nagano, Furukawa; Fumio Sakamoto, Furukawa; Atsushi Itoh, Furukawa, all of Japan

[73] Assignee: Alps Electric Co., Ltd., Tokyo, Japan

[21] Appl. No.: 388,213

[22] Filed: Aug. 1, 1989

[30] Foreign Application Priority Data

Oct. 6, 1988 [JP] Japan ..... 63-250842

[51] Int. Cl.[5] ..... B05D 3/06

[52] U.S. Cl. ..... 427/53.1; 427/264; 427/265; 427/270; 427/271; 427/272; 156/643; 156/652

[58] Field of Search ..... 427/53.1, 264, 265, 427/270, 271, 272; 156/643, 652

[56] References Cited

U.S. PATENT DOCUMENTS 4,117,177 9/1978 Schlufes ..... 427/53.1
4,536,249 8/1985 Rhodes ..... 156/652
4,861,620 8/1989 Azuma et al. ..... 427/53.1

FOREIGN PATENT DOCUMENTS 2131767A 6/1984 United Kingdom .

OTHER PUBLICATIONS

"Formation of Letters in a Plastic Part Subjected to a Sputtering Processing", of Fuji Electric Journal, 1987, vol. 60.

*Primary Examiner*—Stanley Silverman
*Attorney, Agent, or Firm*—Guy W. Shoup; Paul J. Winters

[57] ABSTRACT

A method for making a key top of a push button is disclosed, in which a part of a light intercepting paint, which is the uppermost layer at each of displaying portions on the top surface of the key top, is removed so as to expose a displaying ink printed previously under the layer in accordance with the shape of the display portion.

2 Claims, 4 Drawing Sheets

METHOD FOR FABRICATING A KEY TOP

FIELD OF THE INVENTION

This invention relates to a method for fabricating a key top of a push button, with which various sorts of input devices are provided, and in particular to a method for fabricating a key top of a push button suitable for making the display portion multicolored.

BACKGROUND OF THE INVENTION

Various sorts of methods for fabricating the key top are known. Among them a method called laser processing method is widely adopted as the method for fabricating the key top of the type, in which the display portion emits light.

FIG. 4 is a plan view of a key top fabricated by the prior art laser processing method; FIG. 5 is a cross-sectional view thereof; and FIGS. 6A to 6D are schemes illustrating the fabrication steps by the fabrication method.

In FIGS. 4 and 5, reference numeral 1 indicates globally the key top. On the upper surface of the key top 1, there are formed a first display portion 2 and a second display portion 3, which can be seen from the exterior. The key top 1 stated above consists of a base member 4 made of transparent synthetic resin such as acryl resin, etc., an intermediate layer 5, which is e.g. white, disposed on the surface of the base member 4 and made of light transmitting paint, and an external layer 6, which is e.g. black, disposed on the surface of the intermediate layer 5 except for a part thereof and made of light intercepting paint. The first and the second display portion 2 and 3 are composed of the intermediate layer 5 exposed under the external layer 6. Consequently, at a bright place in the day time, etc., it is possible to confirm the first and the second display portion 2 and 3 by seeing by eye the difference in color between the intermediate layers 5 and the external layer 6, utilizing external light. On the other hand, at a dark place in the night time, in a tunnel, etc., a lamp 7 disposed within the key top 1 is lightened. In this way, it is possible to confirm the first and the second display portion 2 and 3 emitting light at the dark place by using the light passing through only the base member 4 and the intermediate members 5 to reach the exterior.

At the fabrication of the key top 1 constructed as described above, at first, the base member 4 made of acryl resin is formed in a desired shape as indicated in FIG. 6A. Thereafter the intermediate layer 5 is applied on the outer surface of the base member 4, as indicated in FIG. 6B, and an external layer 6 is deposited on the intermediate layer 5 by means of application, sputtering, evaporation, etc., as indicated in FIG. 6C. Further a part of the external layer 6 is irradiated with a light beam 8 emitted by a YAG laser device, as indicated in FIG. 6D. The key top 1 indicated in FIG. 4 is fabricated by removing only the parts of the external layer 6 corresponding to the first and the second display portion 2 and 3 by means of this laser light beam 8. Further, on the whole outer surface of the key top 1, a transparent hard coat layer (not shown in the figure) is deposited at need by means of application, sputtering, evaporation, etc.

However, according to the prior art method for fabricating a key top described above, since the external layer 6 deposited on the whole outer surface of the intermediate layer 5 is removed partially by using a laser light beam 8, the portions of the intermediate layer 5, on which the external layer is removed, constituting the first and the second display portions, 2 and 3, there is a problem that it is difficult to display the two display portions 2 and 3 in different colors to make them multicolored in this way.

That is, if the intermediate layer 5 has a two-layered structure consisting of e.g. a red upper intermediate layer and e.g. a blue lower intermediate layer, which have colors different from each other; the first display portion 2 is formed by removing only the uppermost external layer by means of the laser light beam so as to expose the corresponding part of the upper intermediate layer; and the second display portion 3 is formed by removing the external layer and the upper intermediate layer by means of the laser light beam so as to expose the corresponding part of the lower intermediate layer, theoretically it is possible to form a red first display portion 2 and a blue second display portion 3. However, in practice, if the upper intermediate layer is made of a material, which hardly absorbs the YAG laser light, it is difficult to remove the upper intermediate layer to expose the lower intermediate layer. On the contrary, if the upper intermediate layer is made of a material, which absorbs the YAG laser light, when only the external layer should be removed, the upper intermediate layer is also partly removed. Therefore, in either case, it is difficult to make the display portions multicolored without lowering the display quality.

OBJECT OF THE INVENTION

This invention has been done in view of these circumstances and the object thereof is to provide a key top, which can have multi-colored display portions and has a high display quality.

SUMMARY OF THE INVENTION

In order to achieve the above object, according to this invention, a method for fabricating a key top, in which there are disposed at least two display portions having display colors different from each other on one manipulation surface, is characterized in that it comprises the steps of forming by printing light transmitting displaying inks having colors different from each other on a base member made of a colorless or colored transparent synthetic resin in accordance with the shape of the display portions stated above: then forming a layer made of light intercepting paint so as to cover these displaying inks and the base member stated above; and finally removing a part of this light intercepting paint to expose the displaying inks stated above by means of a laser light beam.

As described above, according to this invention, since a part of the light intercepting paint constituting the uppermost layer is removed to expose the displaying inks formed previously by printing on the underlayer is accordance with the shape of the display portions, it is possible to realize multicolored display portions by selecting the colors for the displaying inks and at the same time to improve the display quality.

DETAILED DESCRIPTION

Figure 1:
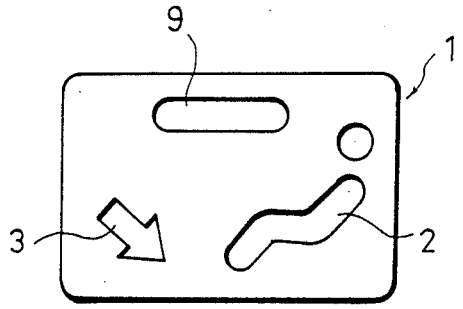
FIG. 1 is a plan view of the key top which is an embodiment of this invention.

Hereinbelow an embodiment of this invention will be explained referring to the drawings.

Figure 2:
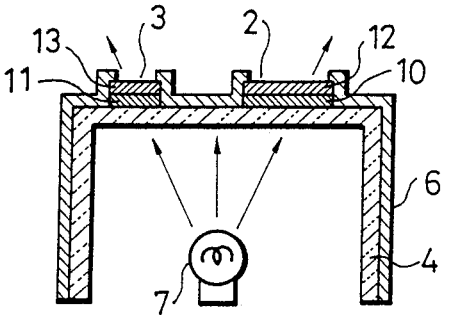
FIG. 2 is a cross-sectional view of the same.

FIG. 1 is a plan view of the key top, which is the embodiment of this invention; FIG. 2 is a cross-sectional view of the same; and FIGS. 3A to 3D are cross-sectional views showing the fabrication steps for the same key top. The items corresponding to those indicated in FIGS. 4 to 6D are represented by the same reference numerals.

As indicated in FIG. 1, there are formed a first and a second display portion 2 and 3, respectively, and a third display portion 9 on the top surface of a key top 1. Among them, the first and the second display portion 2 and 3 are used for displaying the function of the key top 1 and the third display portion 9 is used for displaying the operation indicating the ON-state.

As clearly seen from FIG. 2, the key top 1 stated above consists of a base member 4 made of transparent synthetic resin such as acryl resin, etc.; a first illumination ink 10 formed by printing on the base member 4 is accordance to the shape of the first display portion 2 and a second illumination ink 11 formed by printing on the base member 4 in accordance to the shape of the second display portion 3; a first displaying ink 12 formed by printing on the first illumination ink 10 and a second displaying ink 13 formed by printing on the second illumination ink 11; and an external layer, which is e.g. black, made of light intercepting paint deposited on the surface of the base member 4, removed in accordance with the first, the second and the third displaying portion 2, 3 and 9. A transparent hard coat layer (not shown in the figure) is deposited at need on the whole outer surface of the key top 1. Here the first and the second illumination ink 10 and 11 are made of light transmitting two-component-hardening type inks such as acryl resin, acryl-urethane resin, etc., having either a same color or different colors. In this embodiment, a red first illumination ink 10 and a yellow second illumination ink 11 are used. The first and the second displaying ink 12 and 13 are made of light transmitting two-component-hardening type inks such as acryl resin, acryl-urethane resin, etc., in which pigment absorbing hardly YAG laser light is mixed, which have colors different from each other and also from the colors of the illumination inks forming the underlayer. In this embodiment, a white first displaying ink 12 and a blue second displaying ink 13 are used.

The first displaying portion 2 is constituted by the first displaying ink 12 exposed inside of the external layer 6; the second displaying portion 3 is constituted similarly by the second displaying ink 13 exposed inside of the external layer 6; and finally the third displaying portion is constituted by the base members 4 exposed inside of the external layer 6. Consequently, at a bright place in the day time, etc. it is possible to confirm e.g. the first displaying portion 2 expressed in white on a black ground and the second displaying portion 3 expressed in blue on the black ground by seeing by eye differences in color between the first and the second displaying ink 12 and 13 and the external layer 6, utilizing light coming from the exterior. On the other hand, at a dark place in the night time, in a tunnel, etc., a lamp 7 disposed within the key top 1 is lightened. In this way, for example, the first displaying portion 2 is illuminated in a reddish color synthesized by combining the color of the first illumination ink 10 and that of the first displaying ink 12, utilizing the fact that the light emitted by the lamp 7 is transmitted by the base member 4, the first and the second illumination ink 10 and 11, as well as the first and the second displaying ink 12 and 13. Similarly the second displaying portion 3 is illuminated in a greenish color synthesized by combining the color of the second illumination ink 11 and that of the second displaying ink 13. Further, when a switch (not shown in the figure) disposed within the key top 1 is turned to the ON-state by pushing down the key top 1, since light emitted by another lamp (not shown in the figure) lightened at the same time illuminates the third displaying portion 9, transmitted by the base member 4, it is possible to confirm the operation state of the key top 1 by seeing by eye the third displaying portion 9 thus illuminated, independently of whether it is in the day time or in the night time.

Now the method for fabricating the key top 1 thus constructed as described above will be explained referring to FIGS. 3A to 3D.

Figure 3A:
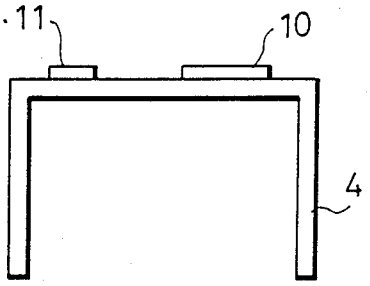
FIGS. 3A to 3D are cross-sectional views showing the fabrication steps for the same key top.
Figure 3B:
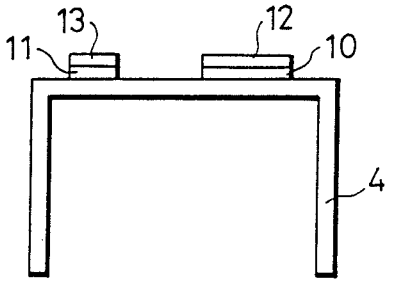
Figure 3C:
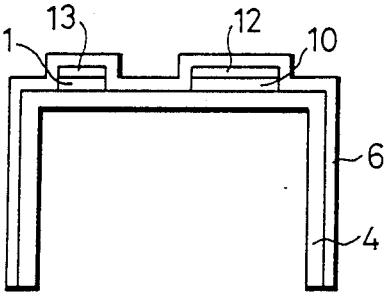
Figure 3D:
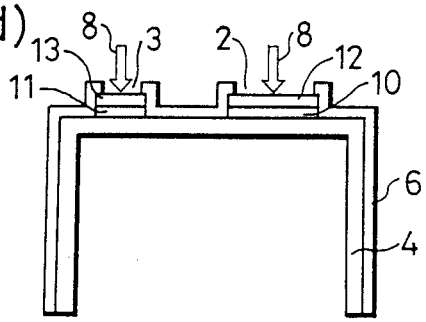
Figure 4:
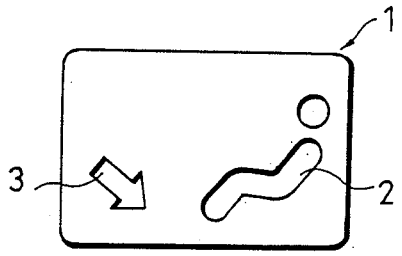
Fig. 4 PRIOR ART
FIG. 4 is a plan view of a prior art key top.
Figure 5:
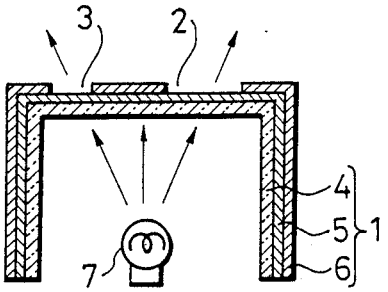
Fig. 5 PRIOR ART
FIG. 5 is a cross-sectional view of the same.
Figure 6A:
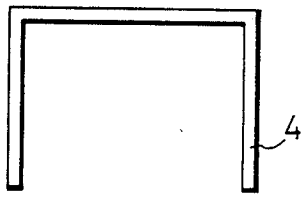
Fig.6(a) PRIOR ART
FIGS. 6A to 6D are cross-sectional views showing the fabrication step for the same key top.
Figure 6B:
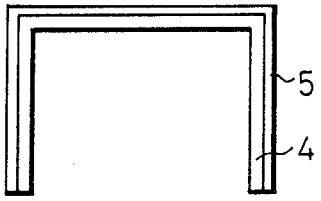
Fig.6(b) PRIOR ART
Figure 6C:
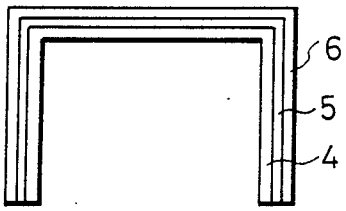
Fig.6(c) PRIOR ART
Figure 6D:
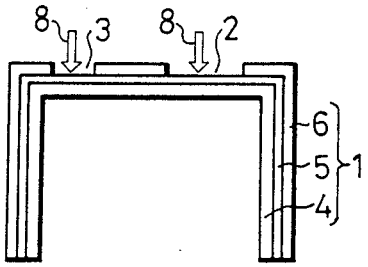
Fig.6(d) PRIOR ART

At first, as indicated in FIG. 3A, the first and the second illumination ink 10 and 11 are formed by printing on the base member 4 made of acryl resin, etc. in accordance with the shapes of the first and the second displaying portions 2 and 3. In this case, both the illumination inks 10 and 11 are printed so that their shape is somewhat larger than the shape of the removal by means of the YAG laser light stated later (i.e. the shape of each of the first and the second displaying portions 2 and 3). Then, as indicated in FIG. 3B, the first displaying ink 12 is printed, superposed on the first illumination ink 10 and the second displaying ink 13 on the second illumination ink 11. Neither illumination ink 10, 11 nor displaying ink 12, 13 is printed at the place corresponding to the third displaying portion 9. Next, as indicated in FIG. 3C, an external layer 6 is formed on the whole outer surface of the base member 4 including the first and the second displaying ink 12 and 13 by means of application, sputtering, evaporation, etc. Therefore, as indicated in FIG. 3D, a part of the external layer 6 is removed by irradiating it with YAG laser light 8. In this case, the first displaying portion 2 is formed by removing the external layer 6 to expose the first displaying ink 12; the second displaying portion 3 is formed by removing the external layer 6 to expose the second displaying ink 13; and the third displaying portion 9 is formed by removing the external layer 6 to expose a part of the base member 4. In this way, the key top 1 indicated in FIG. 1 is fabricated. Further, at need, a transparent hard coat layer (not shown in the figure) is deposited on the whole outer surface of the key top 1 thus obtained.

In the embodiment described above, it is possible to form the displaying portions 2 and 3 having different colors by selecting appropriately the colors for the first and the second displaying ink 12 and 13 exposed on the top surface of the key top 1. Further, by selecting appropriately the colors for the first and the second illumination ink 10 and 11, it is possible to set differently the illumination colors for the first and the second displaying portions 2 and 3 at the illumination in the night time. Still further, since the illumination inks 10 and 11 as well as the displaying inks 12 and 13 can be formed by printing techniques, it is possible to reduce color shear and to improve the display quality. Furthermore, since the third displaying portion 9 is formed by removing the external layer 6 to expose the base member 4, it is possible to form separately colored displaying portions for displaying the functions and a colorless displaying portion for displaying the operation.

In addition, although the case where the first and the second illumination ink 10 and 11 are disposed under the first and the second displaying ink 12 and 13 has been explained in the above embodiment these illumination inks 10 and 11 may not be necessarily formed from the point of view of making the displaying portions multicolored. It is possible to omit the first and the second illumination ink 10 and 11 by using a colored transparent material as the base material 4.

Further the number and the shape of displaying portions 2, 3 in the key top 1 are not restricted to the embodiment described above, but this invention can be applied, also in the case where the displaying portions such as letters, marks, figures, etc. are formed in more than two different colors.

As explained above, according to this invention, it is possible to make the displaying portions multicolored without worsening the display quality and therefore the practical value thereof is high.

What is claimed is:

1. A method for fabricating a key top, in which there are disposed at least two display portions having display colors different from each other characterized in that the method comprises the steps of:

printing at least two areas of light transmitting displaying inks having colors different from each other on a base member made of transparent synthetic resin, said areas having the shape of said display portions;

then forming a layer of light intercepting paint so as to cover said areas and said base member;

finally removing a part of said light intercepting paint to expose said areas by means of a laser beam.

2. A method for fabricating a key top according to claim 1 wherein light transmitting illumination inks having colors different from those of said displaying inks are formed as underlayers of said displaying inks, said illumination inks having the shape of said areas.

* * * * *